US006024230A

United States Patent [19]

Menaged et al.

[11] Patent Number: 6,024,230

[45] **Date of Patent: *Feb. 15, 2000**

[54] MERCHANDISING DISPLAY SYSTEM

[76] Inventors: Neal M. Menaged, 1714 Fredendall Cir., South Hampton, Pa. 18966; Lewis M. Hendler, 1420 Greenwalt Rd., Huntingdon Valley, Pa. 19006

[ * ] Notice: This patent issued on a continued prosecution application filed under 37 CFR 1.53(d), and is subject to the twenty year patent term provisions of 35 U.S.C. 154(a)(2).

[21] Appl. No.: 09/112,124

[22] Filed: Jul. 8, 1998

Related U.S. Application Data

[63] Continuation of application No. 08/604,899, Apr. 12, 1996, Pat. No. 5,803,273, which is a continuation-in-part of application No. 08/517,448, Aug. 21, 1995, Pat. No. 5,678,702, which is a continuation-in-part of application No. 08/250,051, May 27, 1994, Pat. No. 5,443,167.

[51] Int. Cl.[7] ..... A47F 5/00

[52] U.S. Cl. ..... 211/87.01; 211/103; 211/189; 211/59.1

[58] Field of Search ..... 211/87.01, 86.01, 211/105.3, 123, 103, 105.1, 94.01, 105.4, 193, 189, 59.1, 57.1; 248/214, 220.41

[56] References Cited

U.S. PATENT DOCUMENTS

| | | | |
|---|---|---|---|
| D. 320,719 | 10/1991 | Kolsrud et al. . | |
| D. 327,187 | 6/1992 | Swon . | |
| D. 371,026 | 6/1996 | Hendler et al. . | |
| 744,701 | 11/1903 | Pederson . | |
| 2,665,869 | 1/1954 | Samuels . | |
| 2,802,576 | 8/1957 | Kelling | 211/59 |
| 2,987,195 | 6/1961 | Smith | 211/175 |
| 3,032,273 | 5/1962 | Spielman | 211/105.3 X |
| 3,125,042 | 3/1964 | Mapson . | |
| 3,249,233 | 5/1966 | Marcus et al. | 211/105.3 |
| 3,285,208 | 11/1966 | Cohen . | |
| 3,329,282 | 7/1967 | Swan et al. . | |
| 3,677,415 | 7/1972 | Radek . | |
| 3,856,146 | 12/1974 | Levine | 211/134 |
| 3,971,477 | 7/1976 | Bruderly et al. | 211/189 |
| 4,093,078 | 6/1978 | Radek | 211/189 |
| 4,159,814 | 7/1979 | Fious . | |
| 4,561,550 | 12/1985 | Franklin | 211/184 |
| 4,697,712 | 10/1987 | Valiulis | 211/187 |
| 4,785,946 | 11/1988 | Sorensen | 211/187 |
| 5,016,764 | 5/1991 | Bauer | 211/189 |
| 5,104,269 | 4/1992 | Hardison | 211/105.3 X |
| 5,205,421 | 4/1993 | Bustos | 211/59.2 |
| 5,236,095 | 8/1993 | Krizka | 211/105.3 X |
| 5,303,830 | 4/1994 | Metcalf | 211/57.1 |
| 5,443,167 | 8/1995 | Menaged et al. | 211/103 X |
| 5,505,319 | 4/1996 | Todd | 211/95 |
| 5,657,884 | 8/1997 | Zilincar | 211/103 X |
| 5,660,286 | 8/1997 | Shea | 211/87.01 |
| 5,678,702 | 10/1997 | Menaged et al. | 211/87.01 |
| 5,803,273 | 9/1998 | Menaged et al. | 211/87.01 |

OTHER PUBLICATIONS

Undated assembly instructions entitled "Philips Eckerds Gondola Space Saver".

*Primary Examiner*—Robert W. Gibson, Jr.
*Attorney, Agent, or Firm*—Harness, Dickey & Pierce, P.L.C.

[57] ABSTRACT

An auxiliary display assembly for a merchandising display unit is provided. In one application, the auxiliary display assembly is adapted to releasably attach to an upright support member of the gondola display unit and includes first and second cantilever members which are interconnected by an otherwise free standing vertical member. The vertical member is formed to include a plurality of apertures which are adapted to receive a peg member. The auxiliary display assembly is constructed such that the peg member is ultimately positioned substantially parallel to and spaced apart from a wall portion of the gondola display unit. In one form, the vertical member is rotationally attached to the first and second cantilever members. In alternative constructions, the peg members may be integrally formed with the vertical member and the first and second cantilever members include first and second telescopically related parts. The cantilever members are attached to various forms of mounting portions depending upon the particular application for the auxiliary display assembly.

14 Claims, 8 Drawing Sheets

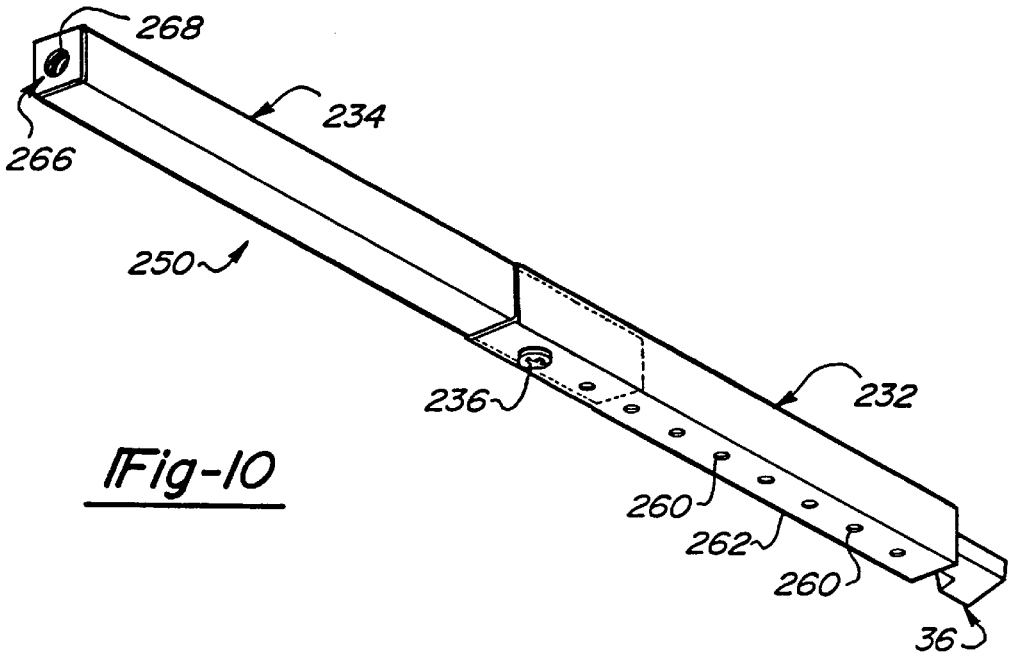
Fig-10
Fig-11
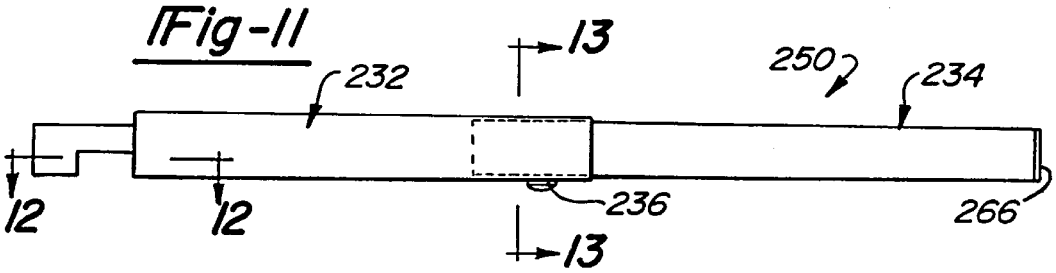
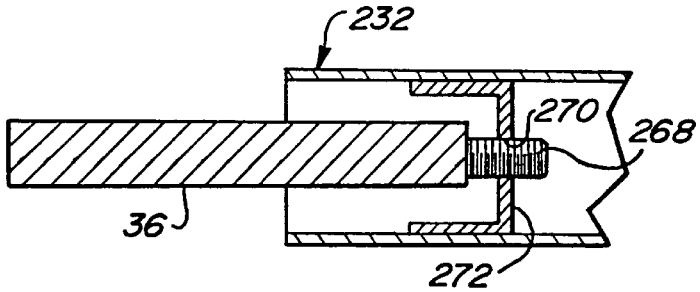
Fig-12
Fig-13
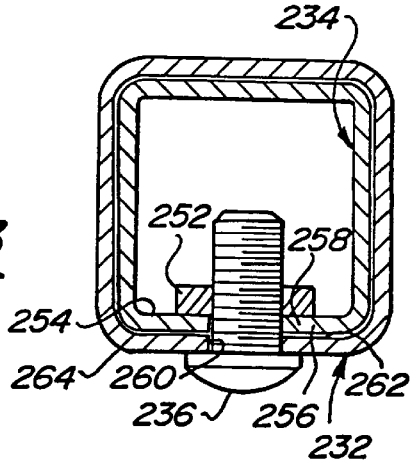

MERCHANDISING DISPLAY SYSTEM

RELATED APPLICATIONS

This application is a continuation of Ser. No. 08/604,899 filed Apr. 12, 1996, U.S. Pat. No. 5,803,273 which is a continuation-in-part application of U.S. Ser. No. 08/517,448, filed Aug. 21, 1995 now U.S. Pat. No. 5,678,702, which is a continuation-in-part of U.S. Ser. No. 08/250,051, filed on May 27, 1994, now U.S. Pat. No. 5,443,167.

BACKGROUND OF THE INVENTION

1. Field of the Invention

The present invention relates, in general, to the display of merchandise for retail sale. More particularly, the present invention relates to an adjustable arm for a merchandising display unit In one application, the adjustable arm of the present invention is used in cooperation with a conventional gondola display unit.

2. Discussion

The self-service retail industry demands efficient display of product while minimizing floor space requirements. The merchandise display capacity of a self-service retail store is inherently limited by the store's square footage of interior space. In this regard, the amount of area available within a store directly limits the amount of product which may be effectively displayed for sale. Heretofore, various merchandising display devices have been employed to increase the merchandising display capacity of a store.

One such device commonly used to increase a store's merchandising capacity is a gondola display unit. In its basic sense, a gondola display unit includes a base, a wall portion upwardly extending from the base from which products can be displayed for sale, and a plurality of spaced apart upright supports attached to the wall portion. The wall portion is constructed from pegboard and includes a multiplicity of apertures equally spaced in rows and columns about its entire surface. Typically, the gondola display units are arranged end to end to define aisleways throughout the interior of a store.

Gondola display units are generally constructed so that they may be utilized in one of two forms-shelf-type units and peg-type units. An illustrative gondola display unit of the shelf-type is described in U.S. Pat. No. 5,205,421. In the shelf-type units, shelves or racks are supported by shelving brackets attached to two adjacent upright supports. Shelf-type units are widely incorporated in self-service retail stores to aesthetically display the product for sale in a manner appealing to the average consumer. The shelf-type units are typically designed to permit an unobstructed view of products, to permit easy removal and replacement of the product on the display, and to provide the capability of storing a limited inventory of products to limit the frequency of restocking the display. Such prior gondola display units have been designed to accommodate various types of products. The gondola shelves afford consumers a clear view of the goods and are approachable from three sides. Further, the shelves of such gondola systems are sufficiently wide to carry a limited inventory of goods.

When the gondola display unit is utilized as a peg-type unit, the product is displayed from pegs adapted to removably engage one or more apertures in the pegboard surface. The pegs are designed to retain a limited supply of product, thereby limiting the frequency of restocking. Such a peg-type unit provides a significant degree of flexibility to readily accept various sized product. Further, such a peg-type system can be readily assembled, unassembled or redesigned. When the gondola display unit is utilized as a peg-type unit, the upright supports do not serve any function.

Other types of display units well know in the art include wire grid display units and slat wall display units. Similar to the peg-type unit described above, wire grid display units and slat wall display units both include an upright wall area adjacent to which products may be releasably suspended for retail sale. Conventionally, both arrangements typically utilize hangers having a mounting portion adapted to releasably engage the upright wall area. The merchandise is then suspended from the hangers.

While prior merchandising display systems have generally proven satisfactory for the display of product in self-service retail stores, none are without their drawbacks and/or limitations. In an attempt to overcome the shortcomings of existing display systems and to further increase display capacity, various devices have been utilized.

One such device used to increase the display capacity of self-service retail store is shown in U.S. Pat. No. 257,709. The device described therein includes an elongated strip which includes a plurality of retainers vertically spaced about its length. An aperture at the end of the elongated strip permits the device to be hanged from a peg or the like. Each of the retainers is designed to hold and retain a single product. The device is intended to be disposed once It is emptied of product.

Another such alternative device for increasing the merchandising display capacity of a self-service retail store is a self-standing "point of sale" display. This type of device is often temporarily utilized to marquee new products and is generally provided by the product manufacturer. Self-standing displays limit available floor space and often impede traffic flow.

One limitation common with most prior known merchandising display system is the limit of the number of facings of merchandise which can be display substantially without obstruction. The usable merchandising space for retail displays is generally limited by the amount of area on a wall-type surface of the unit.

Another problem with many prior merchandising display units is that the display units require a significant amount of floor space. Still yet other prior merchandising display devices need to be hung from hooks or pegs which are often not readily available.

Accordingly, it has been one object of the present invention to provide an auxiliary display assembly which creates additional display space for various types of existing merchandising structures while retaining sufficient consumer visibility of product on the original structure and without impeding traffic flow.

It has been yet another object of the present invention to provide a merchandising display system which increases product sales by increasing product visible to the customer and focuses the view of the customers.

Still yet another object of the present invention is to provide a display assembly adapted to retain goods for retail sale or signage such that the goods or signage are horizontally spaced apart from the main display structure and are facing each opposite direction of adjacent purchaser traffic.

A further object of the present invention is to provide an adjustable arm for a display assembly.

In one form, the present invention is directed to an adjustable arm for a merchandising display unit of the type including an upwardly extending wall portion, the adjustable arm comprising a main body portion including first and second telescopically related members. The first telescopically related member including a plurality of apertures. The second telescopically related member includes an aperture adapted to selectively align with the apertures of the plurality of apertures located on the first telescopically related member. A fastener passes through a selected one of the plurality of apertures in the first telescopically related member and the aperture of the second telescopically related member. The adjustable arm further includes a mounting portion attached to the free end of one of the first and second telescopically related members. The mounting portion interconnects the main body portion and the merchandising display unit. The longitudinal length of the main body portion is adjustable by telescopically moving the first telescopically related relative to the second part telescopically related portion.

One advantage of the present invention is that an auxiliary display arrangement has been provided which allows the capacity of an existing display unit to be quickly and easily increased without obscuring the view of the original product display area.

Yet another object of the present invention is that a merchandising display arrangement has been provided which more effectively displays a large number of products such that the products are visible from the end of an aisle, thereby serving to draw customers down the individual merchandise aisleway.

BRIEF DESCRIPTION OF THE DRAWINGS

These above-stated and other objects and advantages of the present invention will become more readily apparent during the following detailed description taken in conjunction with the drawings herein, in which:

FIG. 10 is a perspective view of a first alternative construction of the adjustable cantilever member shown in FIG. 7;

FIG. 11 is a side view of the cantilever member of FIG. 10;

FIG. 12 is a cross-sectional view taken through the line 12—12 of FIG. 11;

FIG. 13 is a cross-sectional view taken through the line 13—13 of FIG. 11;

DETAILED DESCRIPTION OF THE PREFERRED EMBODIMENTS

Figure 1:
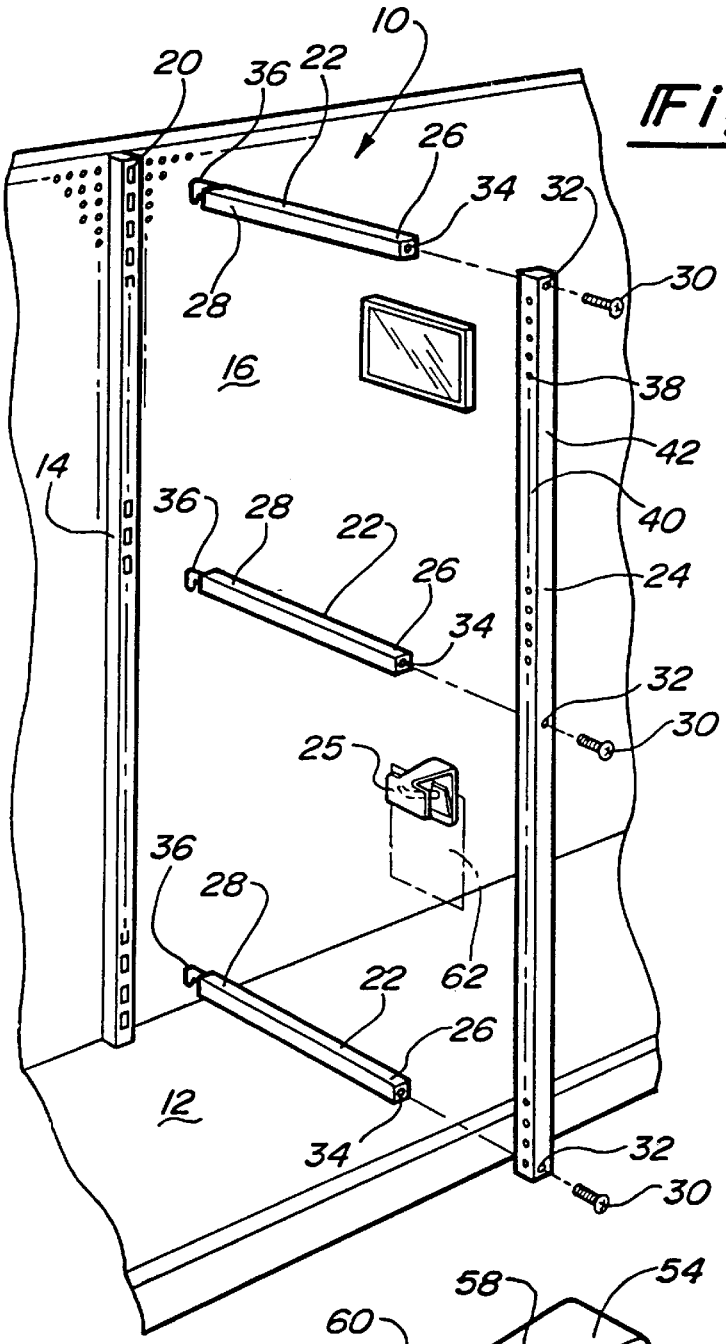
FIG. 1 is a partially exploded perspective view of an auxiliary display assembly constructed in accordance with the teachings of a first preferred embodiment of the present invention shown in operative cooperation with a conventional gondola display unit.

As required, detailed embodiments of the present invention are disclosed herein. However, it is to be understood that the disclosed embodiments are merely exemplary of the invention which may be embodied in various forms. Therefore, specific functional and structural details disclosed herein are not to be Interpreted as limiting, but merely as a basis for the claims and as a representative basis for teaching one skilled in the art to variously employ the present invention in virtually any appropriately detailed structure.

Referring generally to FIGS. 1–4, an auxiliary display assembly for a gondola merchandising display unit constructed in accordance with a first preferred embodiment of the present invention is shown and designated with the reference numeral 10. The auxiliary display assembly 10 of the present invention is primarily illustrated throughout the drawings in operative cooperation with a conventional gondola merchandising display unit. However, the auxiliary display assembly 10 is equally applicable for use with various other types of display units. Such other types of display units include but are not limited to slat wall, pegboard and wire grid. Prior to addressing the details of the first embodiment of the present invention, a brief description of the gondola display unit into which the auxiliary display assembly 10 is intended to be incorporated is warranted.

Figure 2:
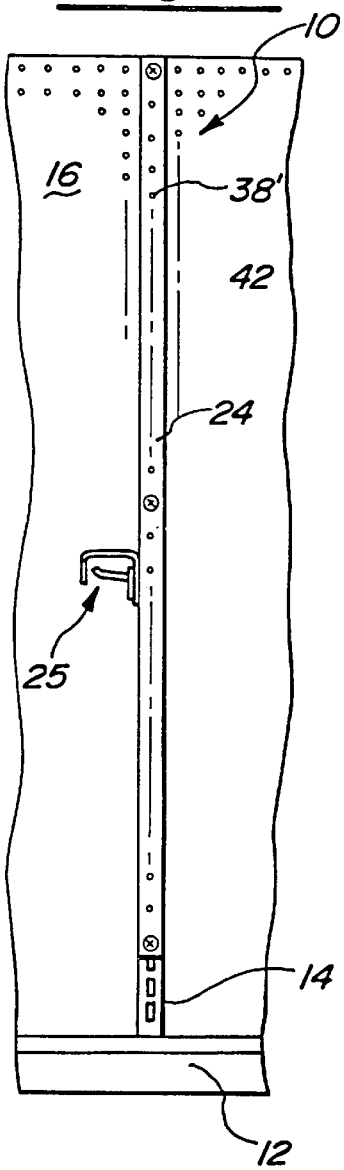
FIG. 2 is a partial side view of the auxiliary display assembly of FIG. 1.

With reference to FIGS. 1 and 2, the gondola display unit is of generally conventional construction and is shown to include a base member 12, at least one upright support member 14, and a wall-type display area 16. The base member 12 is preferably adapted to rest on the store floor (not shown) and provide stability for the remainder of the display unit. The base member 12 shown in FIGS. 1 and 2 is of conventional construction. It will be appreciated by those skilled in the art that similar types of units incorporating a second side which is a substantial mirror image to that shown in FIG. 1 are frequently incorporated to create aisleways within the store interior.

The wall-type display area 16 is constructed of a material commonly referred to as pegboard. The pegboard generally includes a multiplicity of equally sized holes evenly distributed in rows and columns across the entire area of the pegboard. As will be appreciated by those skilled in the art, the pegboard is readily adapted to receive specially designed pegs which are adapted to receive and retain product for display. A typical peg 18 is shown in phantom in FIG. 4 and includes a plurality of product carried thereon. Thus, the pegboard provides a display area 16 from which product can be displayed for sale. The display area 16 is substantially parallel to the aisleway (not shown) defined by two spaced apart gondola display units. As a result, the display area 16 is generally perpendicular to the line of purchaser traffic down the adjacent aisleway. Typically, the pegs 18 adapted to attach to the wall-type display area 16 are sized relative to the width of the base member 12 such that there is frequently a space between the distal end of the pegs 18 and the outermost point of the base member 12.

The upright support member 14 extends vertically from substantially adjacent the base member 12 and includes a plurality of vertically spaced slots 22 arranged in a first column thereon. As will be appreciated by those skilled in the art, such upright support members 14 are typically provided in pairs in equally spaced increments along the length of a gondola display units and are adapted to receive shelf brackets (not shown) and the like. The upright support members 14 are typically spaced apart at intervals of approximately four feet in length.

Figure 4:
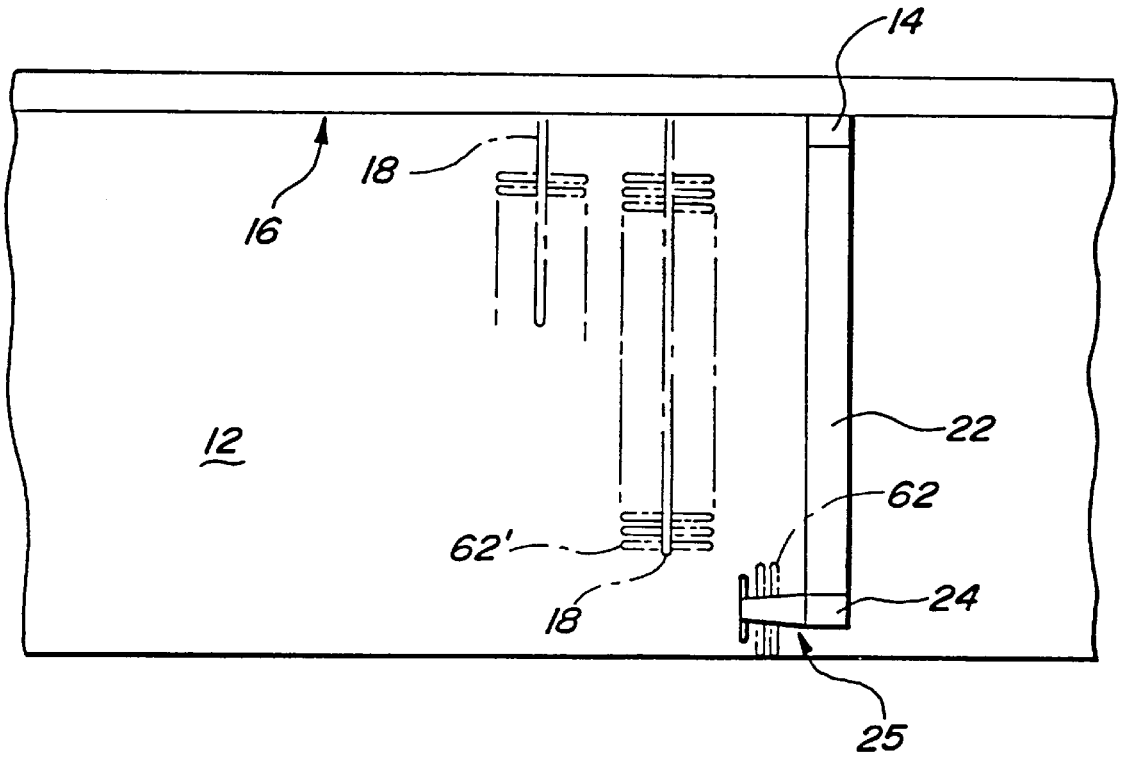
FIG. 4 is a top view of the auxiliary display assembly of FIG. 1 showing a conventional peg extending from the pegboard and carrying a plurality of product (shown in phantom), and further depicting product (shown in phantom) carried by a peg member attached to the auxiliary display assembly.

Referring to FIGS. 1, 2 and 4, the auxiliary display assembly 10 of the first preferred embodiment of the present invention will now be described in greater detail. Preferably, the auxiliary display assembly 10 includes at least two cantilever members 22, a vertical member 24 and at least one peg member 25. In the exemplary embodiment illustrated, the auxiliary display assembly 10 includes three cantilever members 22. The cantilever members 22 each include a distal end 26 attached to the vertical member 24 and a proximal end 28 adapted to removably engage the upright support member 14. It will be appreciated by those skilled in the art, that the exact number of cantilever members 22 incorporated into the auxiliary display assembly 10 is dependent upon such factors as the length of the cantilever members 22, the length of the vertical member 24, and the amount and weight of product to be suspended from the auxiliary display assembly 10.

In the first preferred embodiment, each of the cantilever members 22 is preferably constructed of an elongated metal rod. However, the cantilever members 22 may alternatively be constructed of a plastic material of suitable strength. In the exemplary embodiment, the cantilever members 22 each include a rectangular cross section. The length of the cantilever members 22 is directly dependent upon the width of the base member 12. As will be appreciated more fully below, appropriate relative dimensions between the existing pegs 18 of the gondola display unit, the width of the base member 12 and the cantilever members 22 permit products to be suspended a sufficient distance from the display area 16. As a result, additional display area is created from the otherwise dead space occupied by the upright support member 14 while retaining sufficient visibility of product carried by the pegs 18 attached to the existing pegboard. It will be appreciated by those skilled in the art that the cross section and length of the cantilever members 22 are strictly a matter of design choice and can alternatively be circular or of any other cross-sectional dimension without departing from the scope of the present invention.

The distal end 26 of each of the cantilever members 22 is preferably adapted to receive a threaded fastener such as a screw or a bolt. In the first preferred embodiment, a screw 30 passes through an aperture 32 located at the top, middle, and bottom of the vertical member 24 and engages a threaded aperture 34 formed in the distal end 26 of the cantilever members 22. It Will be appreciated by those skilled in the art that the cantilever members 22 can be alternatively integrally formed with the vertical member 24.

Preferably, the proximal end 28 of each of the cantilever members 22 includes a hook 36 adapted to releasably engage one of the vertically spaced slots 20 formed in the upright support member 14. As a result, the auxiliary display assembly 10 can be installed and removed quickly and easily as a unit to existing display units such as the gondola display unit illustrated throughout the Figures. It will be appreciated by those skilled in the art that the cantilever members 22 alternatively can be releasably attached to the upright support member 14 in any of a number of suitable manners.

In another alternative arrangement, the cantilever members 22 can be permanently attached to the upright support member 14 by welding or the like, if so desired. Permanent fixation of the cantilever members 22 to the upright support member 14 or integral forming of the vertical member 24 and the cantilever members 22 will reduce the structure of the assembly 10 required for carrying retail merchandise. In this regard, the number of cantilever members 22 can be reduced to two and in some applications one, depending on the length of the cantilever member(s) 22 and the weight of retail merchandise or signage intended for suspension from the vertical member 24.

The vertical member 24 of the auxiliary display assembly 10 is preferably rectangular in cross section. Further preferably, the vertical member 24 is formed to include a column of vertically spaced apertures 38 along each of the pair of opposing sides 40 which are adapted to be disposed substantially perpendicular to the wall-type display area 16. The apertures 38 are adapted to receive one or more of the peg members 25. In the exemplary embodiment illustrated, the vertical member 24 does not extend to the base member 12. The clearance afforded between the base member 12 and bottom end of the vertical member 24 is designed to accommodate the display of product on the top of the base member 12. Thus, the distance that the vertical member 24 extends vertically downward is strictly a matter of design choice and can be readily modified to meet the specific needs of an application. For example, if the retail establishment desires to provide "dump buckets" along the top of the base member 12, a greater distance can be provided between the bottom end of the vertical member 24 and the base member 12.

Alternatively, if no storage capacity is desired along the top of the base member 12, the vertical member 24 can extend vertically down to the base member 12. It is anticipated that the vertical member 24 can be releasably attached to the base member 12 with any of a number of known fasteners, or the vertical member 24 can be permanently attached to the base member 12 by welding or any other known method. In such alternative arrangement, the vertical member 24 can be releasably or fixedly attached to the base member 12. With the vertical member 24 attached to the base member 12, a single cantilever member 22 may provide sufficient support for various applications. Similarly, it may be desired to extend the vertical member 24 upward for releasable or permanent attachment to ceiling structure (not shown).

While not preferred, the vertical member 24 of the auxiliary display assembly 10 can be alternatively formed to additionally include a column of vertically spaced apertures 38 (shown in phantom) along its outer side 42, which is substantially parallel to the wall-type display area 16. Such a construction is not preferred since any mounting structure retained by the apertures 38 in the outer side 42 of the vertical member 24 would extend into the adjacent aisleway. However, certain display applications may require this type of arrangement.

The resulting construction of the auxiliary display unit 10 of the first preferred present invention is relatively open. Thereby, a substantially unimpeded view of product carried adjacent to the wall portion 16 is retained.

Figure 3:
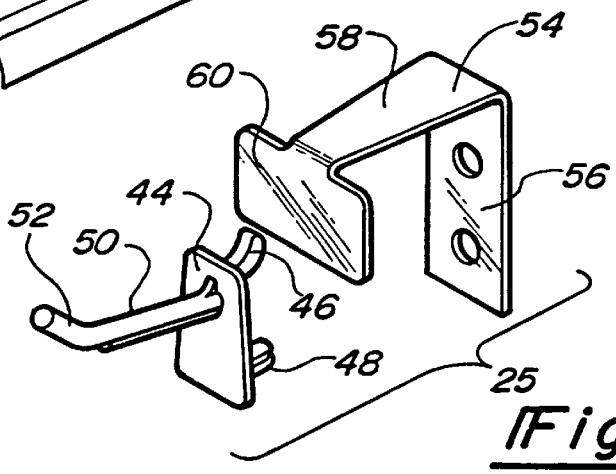
FIG. 3 is an enlarged exploded view of the peg member illustrated in FIGS. 1 and 2.

Turning to FIG. 3, the peg member 25 of the present invention will be described in further detail. The peg member 25 of the present invention preferably includes a main body portion 44, first and second rearwardly extending arm portions 46, 48, and a forwardly extending arm portion 50. The first and second rearwardly extending arms 46, 48 are adapted to engage two of the apertures 38 formed in the vertical member 24. In this regard, the first rearwardly extending arm 46 curves slightly upward relative to the main body portion 44. In use, the first rearwardly extending arm 46 is inserted into one of the apertures 38 of the vertical member 24 and serves to removably retain the peg member 25. As will be appreciated by those skilled in the art, the second rearwardly extending arm 48 cooperates with the first rearwardly extending arm 46 to limit unintended movement or removal of the peg member 25.

The forwardly extending arm 50 of the peg member 25 curves upwardly at its distal end 52 and is attached to the main body portion 44. In the exemplary embodiment illustrated, the forwardly extending arms 50 of the peg member 25 is approximately two inches in length. The length of the forwarding extending arm 50 permits a sufficient capacity to stock products thereon, but does not unnecessarily extend so as to obstruct a consumer's view of and access to product carried by the pegs 18 hung from the pegboard.

The peg member 25 of the present invention is shown to include a two-piece construction that includes a shield portion 54. The shield portion 54 is generally of a L-shaped construction including first and second legs 56, 58. The shield portion 54 is integrally formed to include a planar message portion 60 at the free end of the second leg 58. The planar message portion 60 can be affixed with scanner information or advertising information specific to the product displayed. The shield portion 54 preferably extends beyond the forwardly extending arm 56 of the peg member 25, thereby further tending to retain product carried thereon. The shield portion 50 also functions to protect customer traffic along the adjacent aisleway from inadvertent contact with the forwardly extending arm 50. The shield portion 50 of the peg member 25 is preferably unitarily constructed from a clear plastic material. Further preferable, the material of the shield portion 54 is sufficiently flexible and memory retaining to allow the second leg 54 of the shield portion 54 to be slightly lifted to allow easy loading of the forwardly extending arm 50.

The peg member 25 of the present invention 10 is preferably located such that the forwardly extending arm 50 which is adapted to carry the product extends substantially perpendicular to the adjacent aisleway (not shown) created by the gondola display unit. As specifically shown in FIG. 4, the auxiliary display assembly 10 of the first preferred present invention is designed to utilize the otherwise dead space that exists along conventional gondola display units at the upright support member 14 and the space gap between the distal ends of the pegs 18 and the outermost point of the base member 12. In this regard, the auxiliary display assembly 10 laterally extends from the wall-type portion 16 and is adapted to provide a merchandising display area between the outermost edge of the base member 12 and the ends of the existing pegs 18 (shown in phantom) which extend from the pegboard 20. In this arrangement, product 62 carried by the peg member 25 is effectively displayed without obstructing the customer's view and access to product 62 (shown in phantom) carried by the pegs 18 attached to the wall-type portion 16.

Thus, an additional display area is created in which the product can be displayed such that it is substantially within the view of a customer traveling down the aisleway without the need for the customer to turn his or her head and/or body to face the gondola merchandising display unit. Such a point of purchase display provides the unique abilities to significantly increase merchandising space, feature certain items, permit organization by manufacturer, draw customers off a store's main aisleway and down the individual merchandise aisleways, and provide an attractive and unique display area for impulse purchase items.

Figure 5:
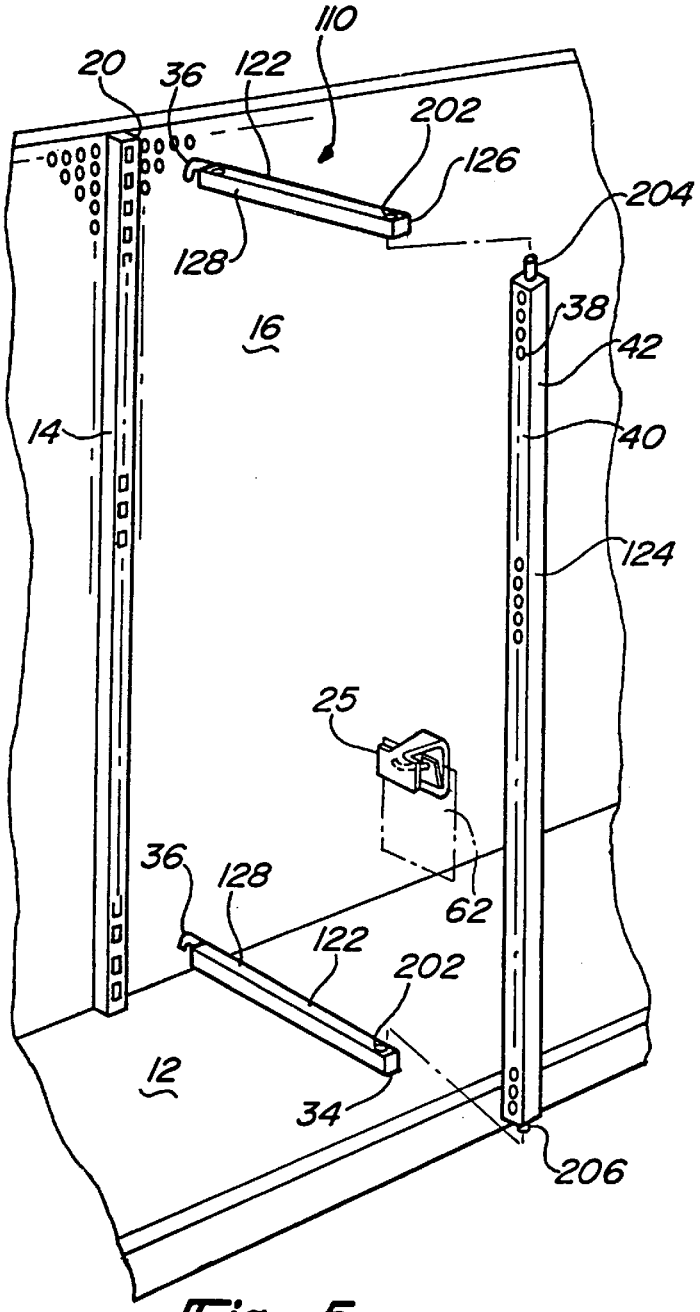
FIG. 5 is a partially exploded perspective view of an auxiliary display assembly constructed in accordance with the teachings of a second preferred embodiment of the present invention.
Figure 6:
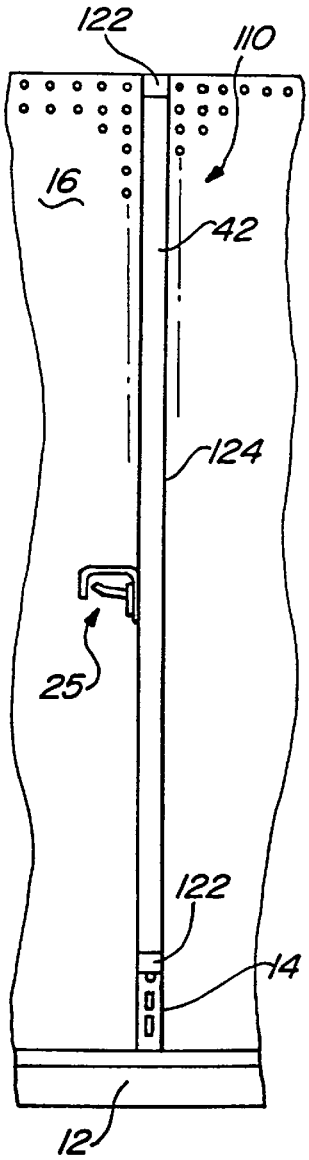
FIG. 6 is a side view of the auxiliary display assembly of FIG. 5.

Turning to FIG. 5, a second preferred embodiment of the auxiliary display system of the present invention is generally identified as 110 and will now be described. In general, the auxiliary display assembly 110 of the second embodiment is substantially identical in function and form to auxiliary display assembly 10 of the first preferred embodiment with the exception of the interconnection of the vertical member 24 and the cantilever members 22. As such, like reference numerals are used to identify components that are substantially identical to those previously described. Modified components are referenced with similar reference numerals increased by a factor of 100. It will be appreciated that the variations discussed above with respect to the first preferred embodiment apply to the second preferred embodiment to the extent applicable.

With continued reference to FIG. 5, the auxiliary display system 110 of the second preferred embodiment of the present invention is shown to include a wall-type display area 16, a base member 12 and an upright support member 14 substantially identically numbered parts of the first embodiment. Also similar to the first embodiment, the second embodiment is shown to include a peg member 25 for releasably suspending product for retail sale. The second preferred embodiment is further shown to include two cantilever members 122 and a vertical member 124. The cantilever members each Include a distal end 126 and a proximal end 128 preferably adapted to releasably engage the upright support member 14. More specifically, each of the cantilever members 122 includes a hook portion 36 adapted to engage one of a plurality of vertically spaced slots 20 formed in the upright support member 14.

In the exemplary embodiment illustrated, the vertical member 124 is rotationally interconnected to the cantilever members 122 for rotation about a generally vertical axis co-linear with the axis of the vertical member 124. In this regard, each of the cantilever members 122 is formed to include a vertical aperture 202 adjacent its distal end 126. The vertical member 124, which is otherwise substantially identical to the vertical member 24 of the first embodiment, is formed to include upwardly and downwardly extending engagement portions 204, 206 adapted to engage the vertical apertures 202 of the cantilever members 122. Preferably, the upwardly and downwardly extending engagement portion 204,206 are generally cylindrical in construction. Vertical member 124 is preferably formed to include a plurality of apertures 138 in each of two oppositely facing sides 40. As a result, when peg members 25 are releaseably attached to the apertures 38, the vertical member 124 can be positioned such that the peg members 25 all extend in a direction generally parallel to adjacent consumer traffic flow. However, it will be appreciated that alternatively a similar plurality of apertures can be formed in a third side 142 of the vertical member 124.

Figure 7:
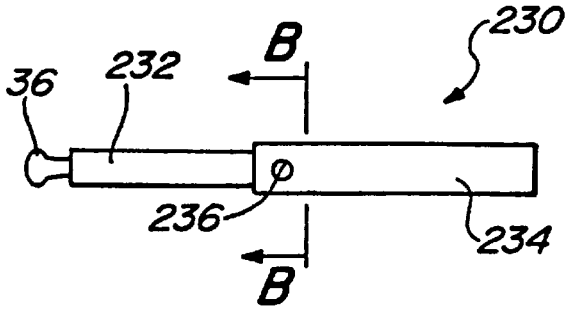
FIG. 7 is a side view of an adjustable cantilever member which is interchangeable with the cantilever members shown in FIG. 1 in connection with the first preferred embodiment and FIG. 5 with the second preferred embodiment.
Figure 8:
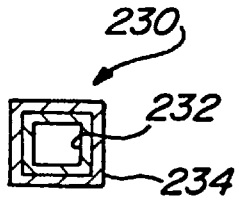
FIG. 8 is a cross-sectional view taken through the line 8—8 of FIG. 7.

With reference to FIGS. 7 and 8, an alternative construction of a cantilever member 230 suitable for use with either of the above-described auxiliary display units 10, 110 is illustrated. The cantilever member 230 is constructed to include first and second telescopically related portions 232, 234. The relative cross-sectional dimension of the first and second telescopically related parts are such that the first telescopically related portion 232 is adapted to be inserted within the hollow interior of the second telescopically related portion 234. The length of the cantilever member 230 is adjustable by telescopically moving the first and second portions 232, 234 relative to one another. Close tolerancing of the first and second portions 232, 234 provides adjustability while retaining structural integrity.

A hook member 36 substantially identically to that shown in connection with the first and second embodiments of the auxiliary display systems 10, 110 is shown interconnected with a first end of the first portion 232 While not specifically illustrated, the distal end of the second portion 234 can be formed similar to cantilever member 22 to include a threaded aperture 34 for fixedly interconnecting the vertical member 124. Alternatively, the distal end of the second portion 234 can be formed to include a vertical aperture 202 for receiving a cylindrical extension 204 when it is desired to rotationally mount the cantilever member 122 to the cantilever members 230.

The position of the vertical member 24 or 124 relative to the upright support member 14 is adjustable by outward telescoping of the second portions 234 relative to the first portions 232 of each of the cantilever members 230. Further in the embodiment illustrated, the cantilever members 122 each include a set screw 236 passing through an aperture (not shown) formed in the second portion 234 and adapted to engage the first portion 232. Tightening of the set screw 236 functions to secure a desired position of the second portion 234 relative to the first portion 232 and thereby a desired length of the cantilever members 122.

Figure 9:
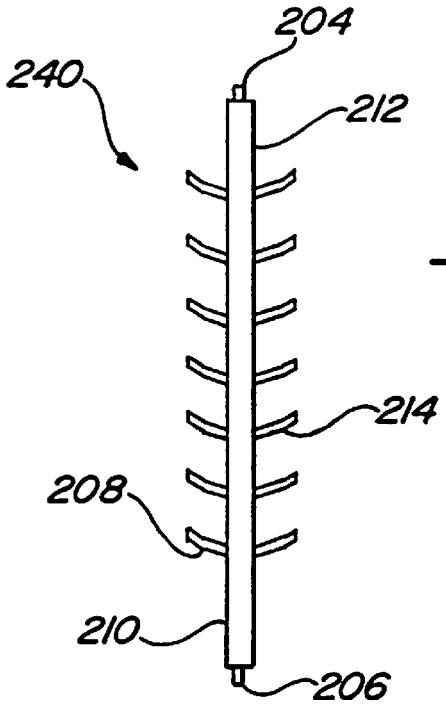
FIG. 9 is a front view of an alternative construction of the vertical member shown in FIG. 1 in connection with the first preferred embodiment and shown in FIG. 5 in connection with the second preferred embodiment.

With reference to FIG. 9, an alternative construction for a vertical member 240 is illustrated. As shown, the vertical member 240 is formed to include upwardly and downwardly extending engagement portions 204 and 206 substantially identical to similar components of vertical member 124. However, it will become apparent to those skilled in the art that the vertical member 240 can be modified to include apertures 32 similar to those found in vertical member 24 when fixed attachment of vertical member 240 to cantilever members 22 is desired. The vertical member 240 is further shown to include a first plurality of hook members 208 integrally formed therewith and extending from a first side 210 of the vertical member 240. Further in the exemplary embodiment illustrated, the vertical member 240 includes a second side 212 which is substantially parallel and spaced apart from the first side 210. The second side 212 is formed to include a second plurality of hook members 214. The hook members of the first and second plurality of hook members 208, 214 are each adapted to releasably suspend a product 62 (shown in FIG. 1) for retail sale.

With reference to FIGS. 10–13, an adjustable cantilever member 250 is illustrated which is an alternative construction of the adjustable cantilever member 230 illustrated in FIG. 7. To a large degree, the adjustable cantilever member 250 is similar in construction and operation to the adjustable cantilever member 230. As a result, common reference numerals will be used to identify substantially identical features between the adjustable cantilever 230 and the adjustable cantilever member 250. The first and second telescopically related portions 232, 234 of the adjustable cantilever member 250 are preferably rectangular in cross section and are secured relative to one another by the set screw 236. In the embodiment illustrated, the inner dimension of the first portion 232 is slightly larger than the outer dimension of the second portion 234, thereby enabling the first portion 232 to telescopically receive the second portion 234.

With specific reference to the cross-sectional view of FIG. 13, the second portion 234 is illustrated to include an internally threaded segment 252 adapted to engage the external threads of the fastener 236. The internally threaded segment 252 is welded or otherwise suitable fastened to an undersurface 254 of a lower side 256 of the second portion 234. In use, after a desired longitudinal length of the adjustable cantilever member 250 is selected, an aperture 258 positioned adjacent the internally threaded segment 252 is aligned with one of a plurality of apertures 260 formed along an underside 262 of the first portion 232. The selected length of the adjustable cantilever member 250 is releasably secured by the threaded fastener 236 which passes through the selected aperture 260 of the first portion 232 and the aperture 258 of the second portion 234 so as to engage the internal threads of the internally threaded segment 252. Upon tightening, the lower side 256 of the second portion 234 is drawn against an innersurface 262 of a lower side 264 of the first portion 232 providing a rigid connection therebetween.

A distal end of the second portion 234 is shown to include a cap member 266 formed to include an internally threaded aperture 268 therein. The aperture 268 of the cap member 266 is operative to receive the threaded fastener 30 for purposes of interconnecting the vertical member 124 thereto. In the embodiment illustrated, the cap member 266 is securely attached to the second portion 234 by welding or another suitable technique well known in the art.

At the distal end of the first portion 232, the adjustable cantilever member 250 includes a mounting portion. In the embodiment illustrated, the mounting portion is a hook member 36 substantially identical to that shown and described above. As shown in the cross-sectional view of FIG. 12, the hook member 36 is welded or otherwise suitable attached to a threaded rod portion 268 which engages an aperture 270 formed in a plate 272 located within the first portion 232 The threaded relationship between the hook member 36 and the first portion 232 allows the hook member 36 to be selectively adjusted longitudinally relative to the first portion 232 through rotation thereof.

Turning now to FIGS. 14 through 19, three additional alternative cantilever members are illustrated and will be described. As will become apparent below, the alternative cantilever members operate to adapt the teachings of the present invention for use with other types of merchandising displays. It will be appreciated that the remaining cantilever members are substantially identical to the adjustable cantilever member 250 with the exception of the specific mounting arrangement employed. Thus, the description for the remaining cantilever members will be primarily directed to their respective mounting arrangements. Importantly, the various mounting portions permit the auxiliary display assembly of the present invention to be releasably mounted to the upright wall portion of various display units, such as pegboard, slat wall and wire grid. It will be appreciated by those skilled in the art that further applications may be possible with other mounting portions.

Figure 14:
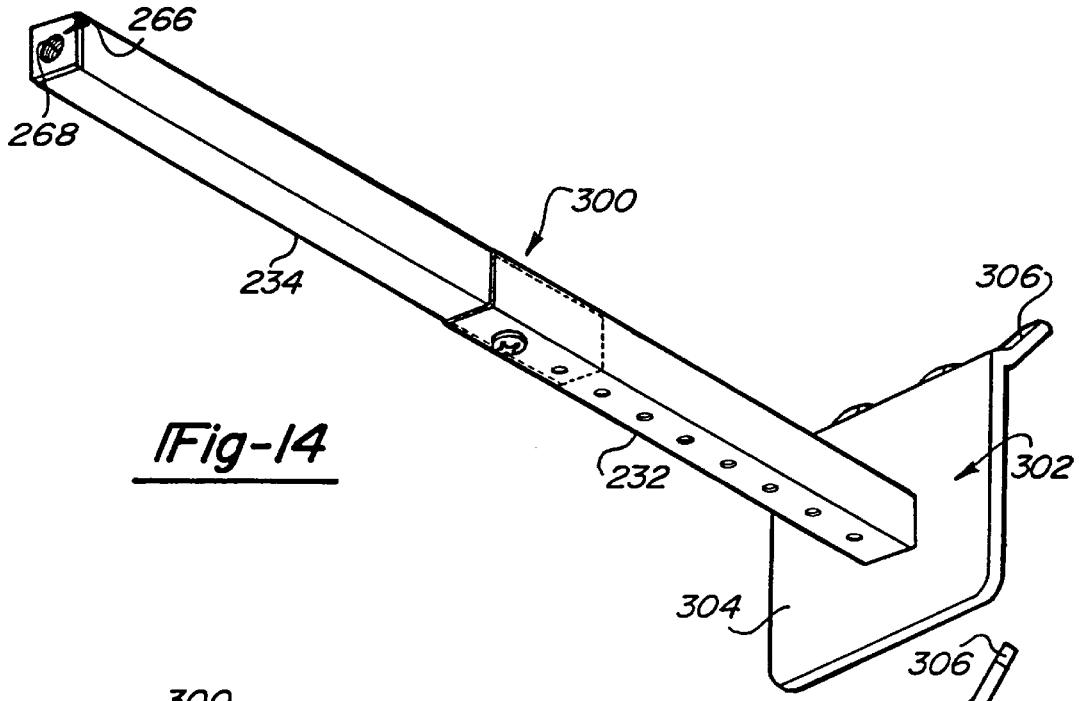
FIG. 14 is a perspective view of a second alternative construction of the adjustable cantilever member shown in FIG. 7 which is adapted to releasably engage a pegboard wall.
Figure 15:
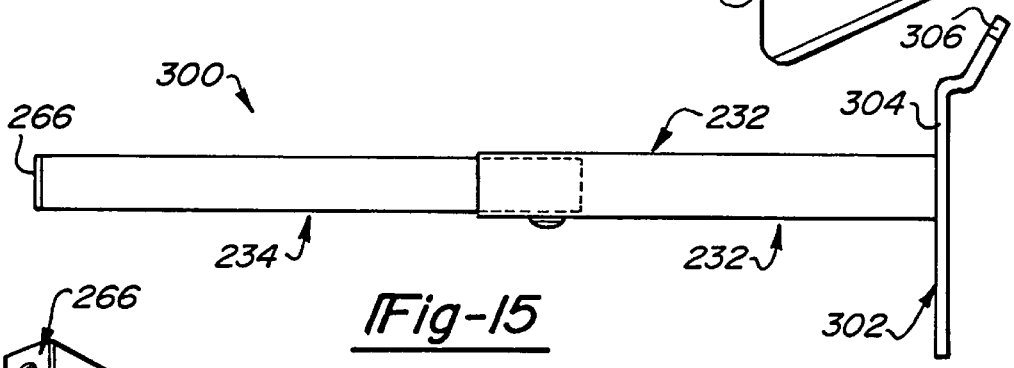
FIG. 15 is a side view of the cantilever member of FIG. 14.

With specific reference to FIGS. 14 and 15, an adjustable cantilever member 300 is illustrated having a mounting portion 302 adapted to releasably engage a pegboard wall. The mounting portion 302 includes a generally planar plate section 304 which lies in a plane generally perpendicular to the longitudinal axis of the first and second telescopically related portions 232, 234. Integrally formed with and upwardly extending from the plate section 304 are a plurality of prongs 306 adapted to releasably engage a corresponding plurality of apertures of the pegboard in a substantially conventional manner. In the embodiment illustrated, the mounting portion 302 includes four (4) upwardly extending prongs. However, it will be appreciated by those skilled in the art, that the particular number of prongs incorporated depends on the weight of the adjustable cantilever member 300 and the anticipated weight of the retail merchandising to be suspended therefrom and is largely a matter of design choice. The first portion 232 is welded or otherwise suitably attached to the plate section 304 of the mounting portion 302.

Figure 16:
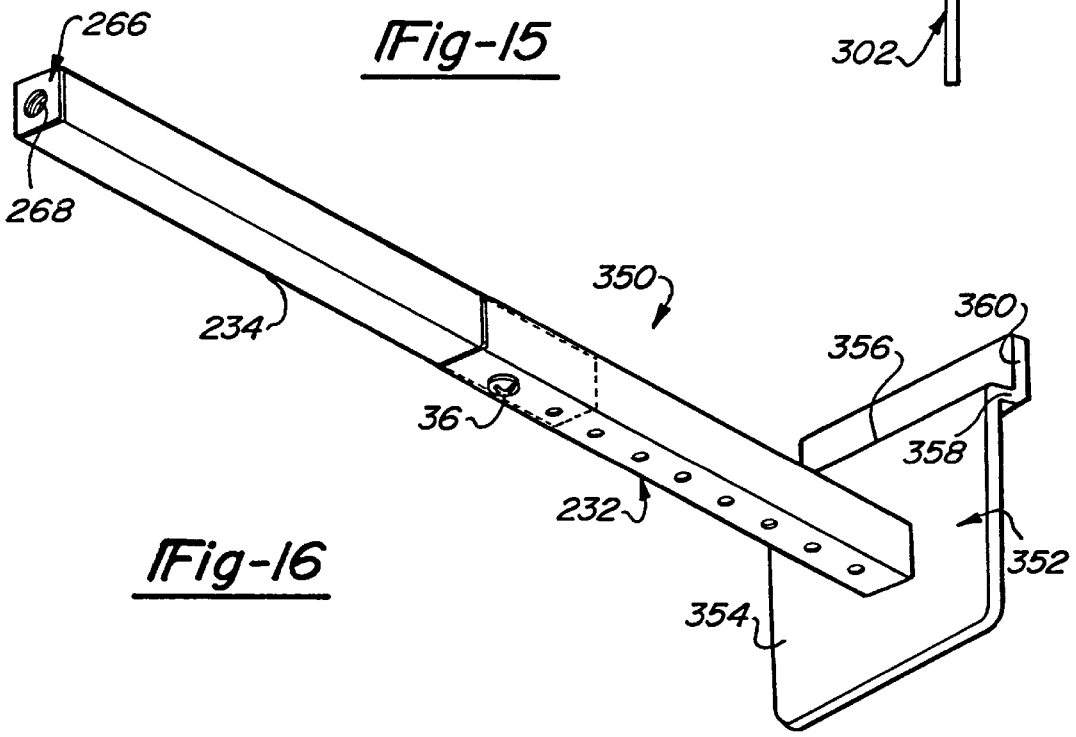
FIG. 16 is a perspective view of a third alternative construction of the adjustable cantilever member shown in FIG. 7 which is adapted to releasably engage a slat wall display unit.
Figure 17:
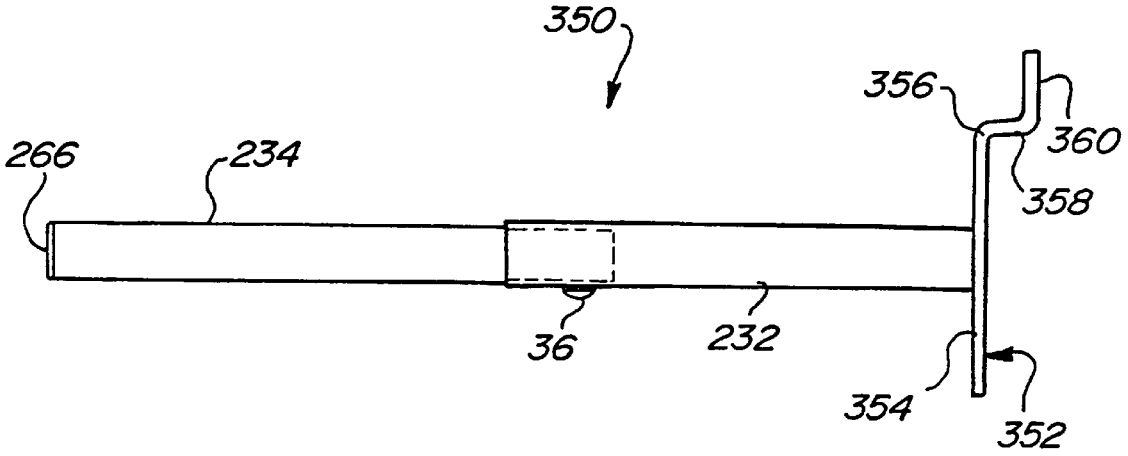
FIG. 17 is a side view of the cantilever member of FIG. 16.

Turning now to FIGS. 16 and 17, an adjustable cantilever member 350 is illustrated which includes a mounting portion 352 adapted to releasably engage a slat wall. The mounting portion 352 includes a plate section 354 similar to the plate section 304 of the adjustable cantilever member 300. Adjacent an upper edge 356, the mounting portion 354 includes a rearwardly extending flange 358 which interconnects the plate section 354 with an upwardly extending lip 360. In the embodiment illustrated, the plate section 354, flange 358 and lip 360 are of the mounting member 352 are integrally formed. The mounting portion 352 functions to engage a slat wall in a generally conventional manner.

Figure 18:
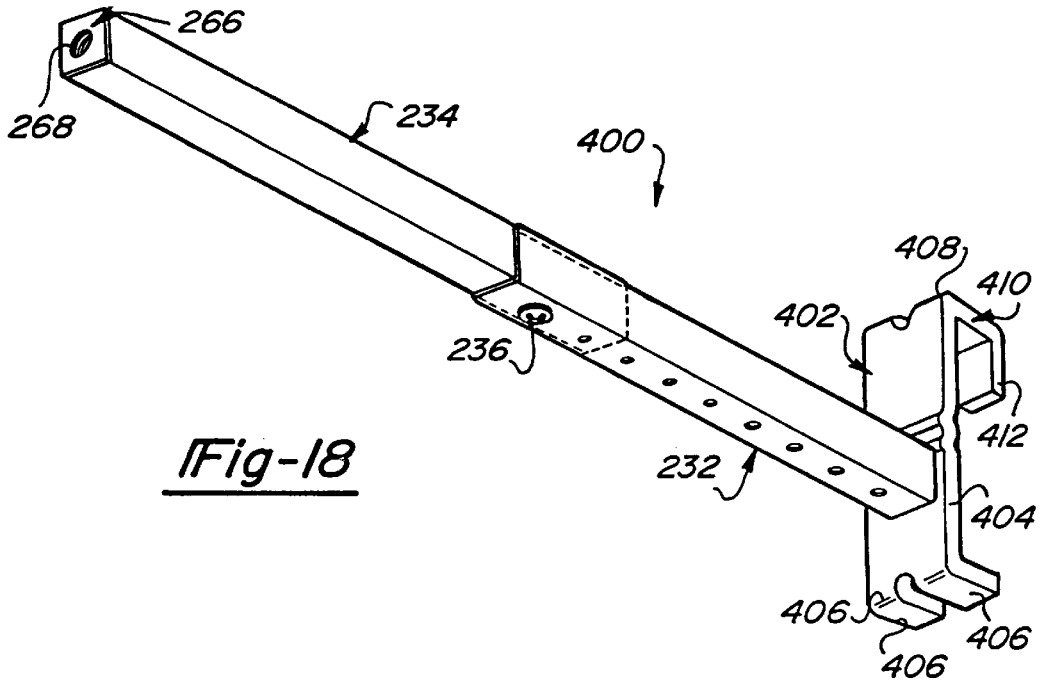
FIG. 18 is a perspective view of a fourth alternative construction of the adjustable cantilever member shown in FIG. 7 which is adapted to releasably engage a wire grid display unit.
Figure 19:
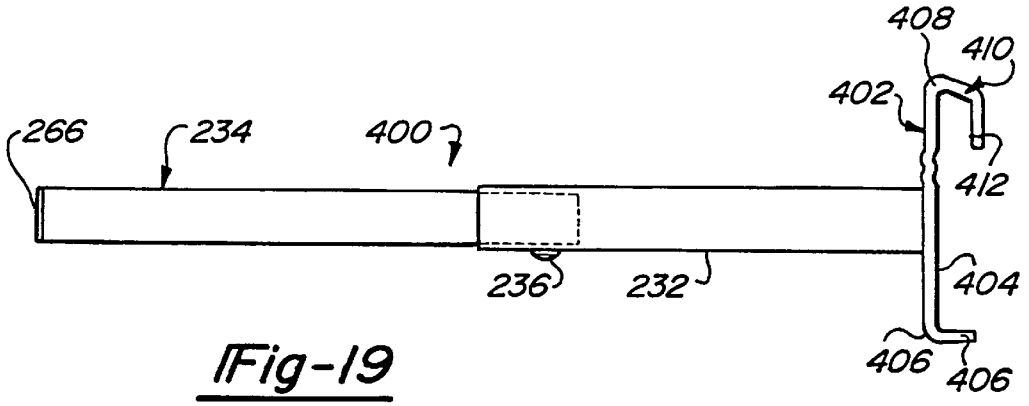
FIG. 19 is a side view of the cantilever member of FIG. 18.

Turning finally to FIGS. 18 and 19, an adjustable cantilever member 400 is illustrated which includes a mounting portion 402 adapted for releasable securement to a wire grid. The mounting portion 402 includes a plate section 404 disposed generally perpendicular to the longitudinal axis of the first and second portions 232, 234. At a lower edge 406, the plate 404 is integrally connected with a pair of rearwardly extending legs 406. Adjacent an upper edge 408, the plate section 404 is integrally interconnected with a pair of L-shaped legs 410. The distal segments 412 of the L-shaped legs extend downwardly and is generally parallel to the plane of the plate section 402. The pair of rearwardly extending legs 406 and the pair of L-shaped legs 410 cooperate to releasably engage a wire grid in a generally conventional manner.

While it will be apparent to those skilled in art that the preferred embodiments of the present invention are well calculated to fulfill the above-stated objects and advantages, it will also be appreciated that the teachings of the present invention are susceptible to modification, variation and alteration without departing from the scope and spirit of the claims as set forth below. For example, it is anticipated that alternative constructions of a vertical member may be employed which are not linear. In this regard, the vertical member may be modified to include a stepped portion or an arcuate portion. In such an alternative construction, it may be required to utilize non-adjustable cantilever members of differing lengths or adjustable members adjusted to differing lengths.

We claim:

1. A merchandising display system for merchandising products, the system comprising:

a gondola display unit including a base member and an upwardly extending wall portion;

an auxiliary display assembly including at least one cantilever member and a tubular vertical member, said at least one cantilever member including a distal end connected to said vertical member and a proximal end removably attached to said gondola display unit; and a merchandise holder adapted to receive and retain a plurality of products, said merchandise holder releasably engaging said tubular vertical member such that said merchandise holder is positioned horizontally spaced apart from said upwardly extending wall portion and extends substantially parallel to said upwardly extending wall portion;

whereby a space between said gondola display unit and said tubular vertical member is interrupted only by said at least one cantilever member.

2. The merchandising display system of claim 1 wherein said at least one cantilever member is tubular.

3. The merchandising display system of claim 1 wherein said vertical member is substantially rectangular in cross section.

4. The merchandising display system of claim 3, wherein said vertical member is fixedly attached to said at least one cantilever member.

5. The merchandising display system of claim 1, wherein said at least one cantilever member includes a first cantilever member and a second cantilever member.

6. The merchandising display system of claim 1, wherein said at least one cantilever member is telescopically extendable.

7. The merchandising display system of claim 3, wherein said gondola display unit includes an upright support member extending vertically from substantially adjacent said base member, said upright support member being attached to said upwardly extending wall portion and including a first column of vertically spaced slot, and further wherein said proximal end of said at least one cantilever member includes a hook portion engaging one of said vertically spaced slots of said upright member.

8. The merchandising display system of claim 1, wherein said at least one cantilever member and said vertical member have substantially identical cross-sectional dimensions.

9. A merchandising display system for merchandising products comprising:

a display assembly including at least one tubular cantilever member and a tubular vertical member, said tubular vertical member having a first face and a second face, said at least one tubular cantilever member including a distal end connected to said vertical member and a proximal end; and a merchandise holder adapted to receive and retain a plurality of products, said merchandise holder releasably engaging said tubular vertical member on said first or second faces, the merchandise holder extending in a direction normal to the at least one cantilever member;

whereby an uninterrupted space having a generally rectangular configuration is at least partially defined by said at least one cantilever member and said vertical member.

10. The merchandising display system of claim 9, wherein said vertical member is substantially rectangular in cross section.

11. The merchandising display system of claim 9, wherein said tubular vertical member is fixedly attached to said at least one tubular cantilever member.

12. The merchandising display system of claim 9, further comprising a gondola display unit having an upright support member extending vertically from a base member, said upright support member being attached to an upwardly extending wall portion and including a first column of vertically spaced slot, and further wherein said proximal end of said at least one tubular cantilever member includes a hook portion engaging one of said vertically spaced slots of said upright member.

13. A merchandising display system for merchandising products comprising:

a display assembly including at least one cantilever member and an elongated vertical member, said elongated vertical member having first and second opposing faces, said at least one cantilever member including a distal end non-rotatably connected to said elongated vertical member and a proximal end; and a merchandise holder adapted to receive and retain a plurality of products, said merchandise holder releasably engaging said elongated vertical member on at least one of said first and second opposing faces;

whereby an uninterrupted space having a generally rectangular configuration is at least partially defined by said at least one cantilever member and said vertical member.

14. The merchandising display system of claim 13, wherein said vertical member has a dimension in a direction parallel to said at least one cantilever member which is substantially less than a horizontal dimension of said uninterrupted space.

* * * * *